United States Patent [19]

Takai

[11] Patent Number: 4,819,962

[45] Date of Patent: Apr. 11, 1989

[54] NOTEBOOK PROVIDED WITH PAGES CONTAINING A WINDOW-LIKE APERTURE

[75] Inventor: Hiromitsu Takai, Fujisawa, Japan

[73] Assignee: Ori-Pro Company, Limited, Tokyo, Japan

[21] Appl. No.: 129,215

[22] Filed: Dec. 7, 1987

[30] Foreign Application Priority Data

Dec. 5, 1986 [JP] Japan ..... 61-186799

[51] Int. Cl.[4] ..... B42D 1/00; B42D 1/08; B42D 3/00; B42D 15/00

[52] U.S. Cl. ..... 281/15.1; 281/22; 281/31; 283/63.1

[58] Field of Search ..... 281/1, 3, 15 R, 22, 281/31; 283/63; 282/1, 2, 8, 22; 40/359, 360, 153

[56] References Cited

U.S. PATENT DOCUMENTS

| | | | |
|---|---|---|---|
| 19,525 | 12/1889 | Koch | 281/22 |
| 19,528 | 12/1889 | Petri | 281/22 |
| 1,941,236 | 12/1933 | Urbain | 281/15 R |
| 2,444,355 | 6/1948 | Kniznick | 281/22 |
| 2,828,975 | 4/1958 | Wright | 281/31 |
| 2,879,774 | 3/1959 | Siegel | 281/31 |
| 3,744,541 | 7/1973 | Branhut | 281/31 |
| 3,753,581 | 8/1973 | Kamstra | 283/63 |
| 4,165,193 | 8/1979 | Gestetner | 281/31 |
| 4,537,576 | 8/1985 | Thorsheim et al. | 281/15 R |

*Primary Examiner*—Frank T. Yost
*Assistant Examiner*—Paul M. Heyrana, Sr.
*Attorney, Agent, or Firm*—Edwin E. Greigg

[57] ABSTRACT

The present invention discloses improvements in notebook-like products, such as notebooks, books, picture books and bank books, in which a window-like aperture is cut from at least some of the pages, and a pocket having a transparent face is mounted inside the front cover, the back cover, or both, of the notebook, the pocket being disposed directly opposite the window-like apertures so that an indicia-bearing element, such as a picture, a photograph, a calendar or short notes can be slipped into the pocket for viewing through a series of adjacent pages.

4 Claims, 3 Drawing Sheets

NOTEBOOK PROVIDED WITH PAGES CONTAINING A WINDOW-LIKE APERTURE

BACKGROUND OF THE INVENTION

1. Field of the Invention

The invention relates to improvements in paper notebooks.

2. Prior Art

A notebook of the familiar type simply uses a number of rectangular sheets of paper bound together on one side. Each page is made of a single sheet of paper, and the pages are all identical. Although one can occasionally find notebooks with a picture or photograph printed in the corner of each page, most notebooks are made for practical uses only. Notebooks do not generally include decorative elements other than in the external cover areas.

There are also known in the prior art loose-leaf or spiral-bound notebooks with small aligned holes on each page. These holes, however, are suitable for binding purposes only.

As described only, notebooks of the usual, known type are made for practical uses only and lack creative or attractive elements. In other words, they are too plain for their use to be enjoyable for the user. Furthermore, such notebooks lack features that would allow the user to customize them by adding personal or creative touches to their notebooks.

OBJECTS OF THE INVENTION

The present invention is specifically designed to address the problem presented by the known notebooks and has as its object providing a notebook with one or more series of window-like apertures cut from the pages seriatim.

It is a further object of the invention to provide a means by which the pocket can display an item such as a photograph for viewing.

That object is achieved by providing a pocket means mounted inside the front or back cover of the notebook, or both, the pocket being provided with a trasnparent face through which a flat, indicia-bearing or graphic element such as a photograph, picture or calender can be viewed. In this manner, the indicia bearing element can be freely inserted in the pocket and removed therefrom, and the graphic element can be seen from any page to which the book might be opened for use through the respective series of window-like apertures in the adjacent pages.

SUMMARY OF THE INVENTION

A notebook according to the present invention consists of one or more window-like apertures having a desired shape cut out in at least one chosen location on the page from some or all of the pages in the notebook and one or more pocket means having a transparent face mounted inside the front cover, the back cover, or both, directly opposite the window-like apertures in the pages, each pocket means presenting at least one lateral opening so that a flat, indicia bearing element such as a picture, a photograph, a calender or short notes can be freely slipped in or out of the pocket means for viewing from any page through the respective window-like apertures.

Alternatively, the shape and size of the apertures can differ for each page, so that when the user flips through the pages, the user experiences a sense of motion viewing the changes in the window-like apertures and in the indicia-bearing element displayed therethrough.

In addition, by varying the size and shape of the apertures from page to page throughout the notebook, or by assigning a different size and shape of window to each specific subject, or by revealing different labels through the aperture, the user can readily identify the page he is viewing. In this fashion the apertures could serve as an indexing device to the contents of the notebook, i.e., to provide the user a locational reference independent of a table of contents, or other page or chapter numbering scheme.

Since the present invention relates to a notebook that contains window-like apertures cut out of the pages and one or more pockets mounted inside the front and/or back cover directly opposite the window-like apertures, allowing an indicia-bearing element to be freely slipped in or out, the user can view the element from any page and, while using the notebook, is constantly reminded of any given topic or special notes displayed by the element contained in the pocket(s). Thus, the user can design even more creative uses for his notebook, uses that are not possible with any known notebook.

Alternatively, if a notebook provided with the invention is suitably bent while rapidly flipping its pages with the thumb, the windows will move forward or backward, creating an effect similar to that of a motion picture. The process creates an optical illustion of motion for the picture or photograph inserted in the pocket as though one were watching a film.

Furthermore, if the size and shape of windows varies from page to page, for example, if its shape increases or decreases from back cover to front cover, the user, by turning the pages, can enjoy observing "changes" in the illustration inside the pocket, at least to the extent of how much that illustration was revealed to the eye. This further enhances the attractiveness and creative utility of this invention.

DESCRIPTION OF THE PREFERRED EMBODIMENTS

Figure 1:
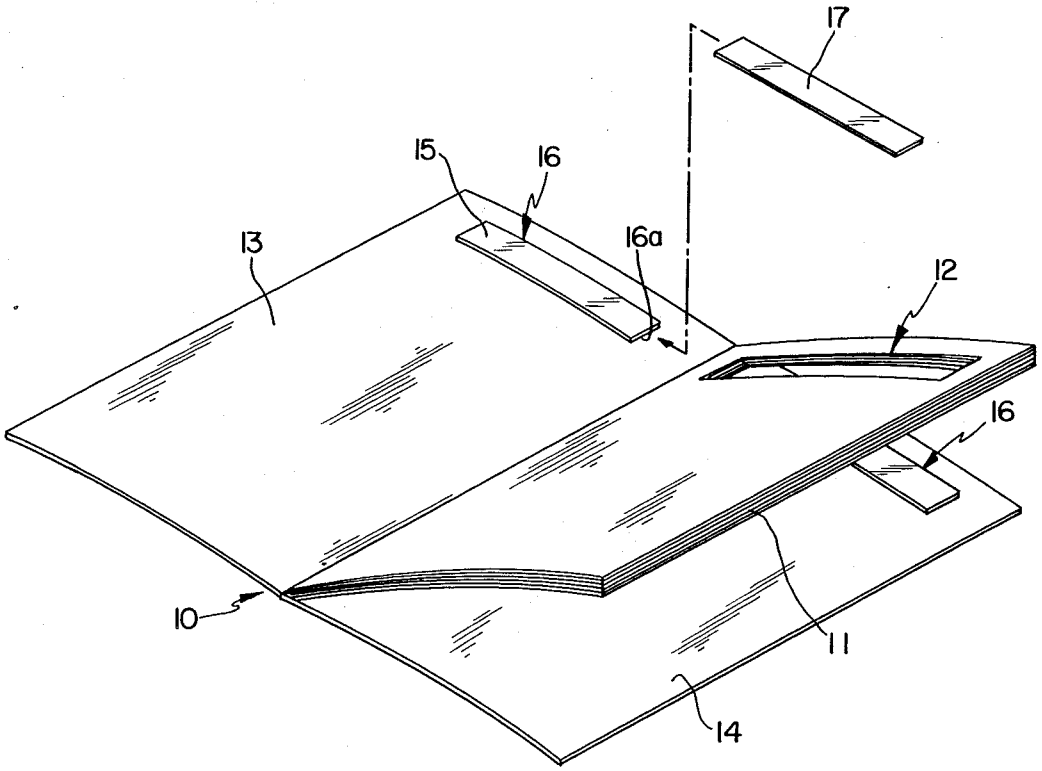
FIG. 1 is a perspective view of a first embodiment of the notebook according to the invention.

The various embodiments of the present invention will now be described in detail in connection with the foregoing five figures of drawings:

FIG. 1 shows a notebook 10 provided with window-like apertures and bound on one side, the notebook consisting of the pages of the notebook (11), means defining a rectangular window-like aperture (12) in each page, the inside of the front cover (13), and the inside of the back cover (14). A pocket means (16) having a transparent face (15) is disposed opposite the window-like apertures inside the front cover (13). Pocket (16) has at least one opening (**16*a***) provided thereon to the left and/or the right side, and a flat indicia-bearing element (17), such as a picture, a photograph, a calender or short notes, can be slipped in or out of the pocket through that at least one opening (16*a*).

An illustration of use of the invention follows. In this example, a landscape is slipped into the pocket (16). This landscape can then be viewed through the window-like apertures (12) from any page (11) to which the notebook might be opened. In addition, the window-like aperture may appear to create a sense of motion to the picture when the pages are flipped, which provides another creative use of the invention. Naturally, the flat, indicia-bearing element slipped into the pocket (16) can be replaced by another item at any time. If a replacement element showing "headings" or "special notes" is inserted, for instance, the user can always read them from any page.

Figure 2:
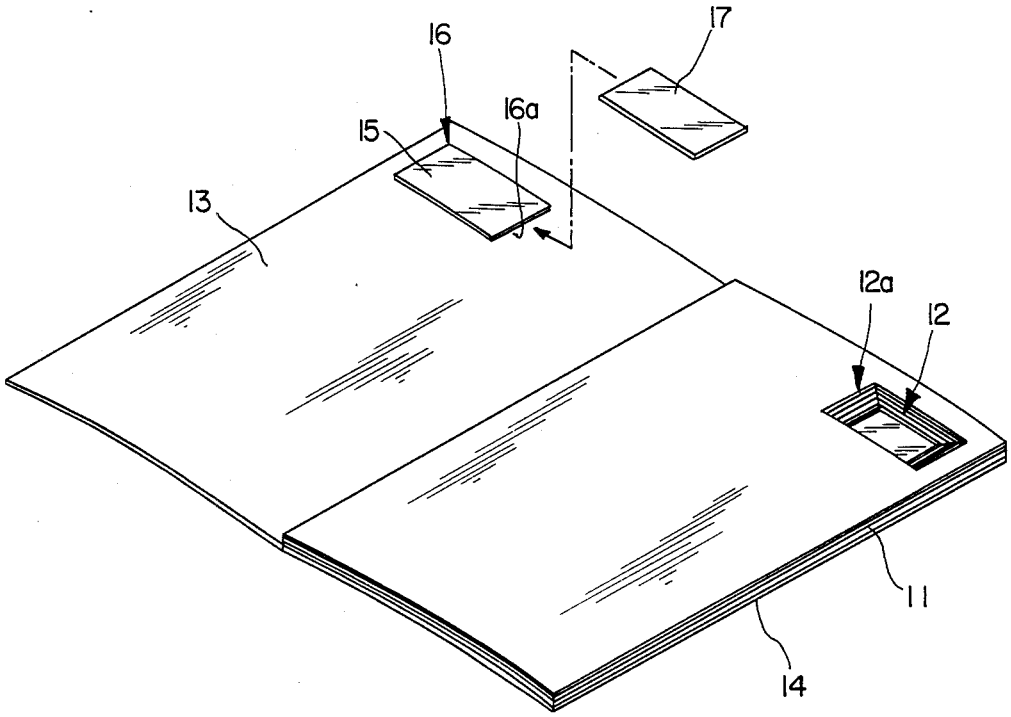
FIG. 2 is a perspective view of a second embodiment of the invention.
Figure 3:
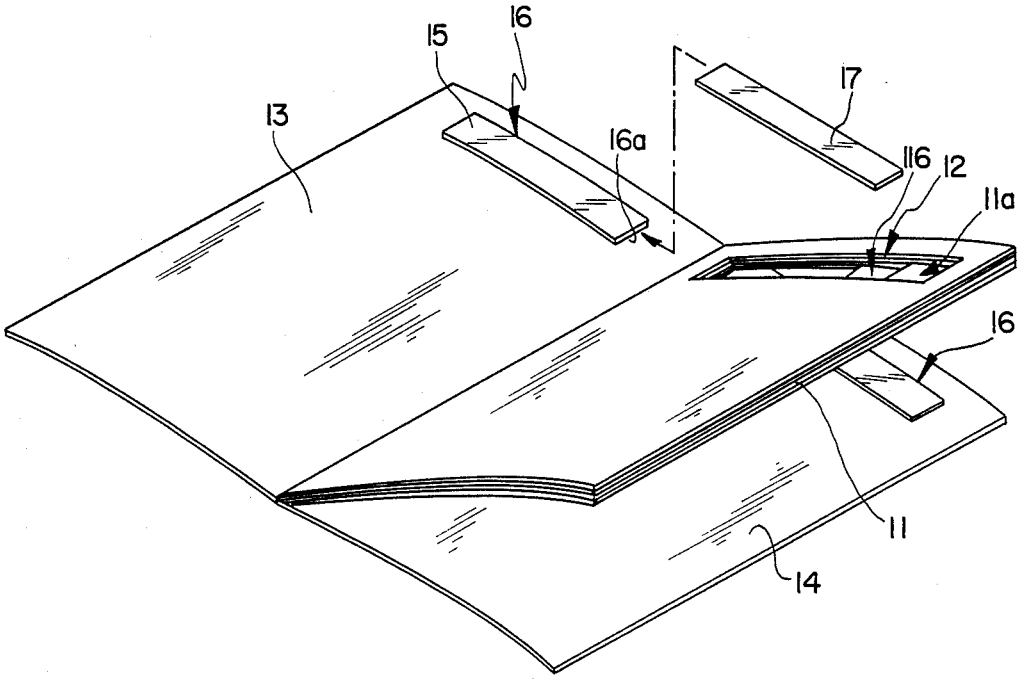
FIG. 3 is a perspective view of a variant form of the embodiment of FIG. 1, in which the shape of the window-like apertures is stepped every one or more pages.

FIG. 2 is another embodiment of the notebook of this invention. In this example, the window-like aperture gradually decreases in size from the front to the back of the notebook, creating a frame-like wall effect (12*a*) for the displayed element. This embodiment creates the effect that letters or drawings on the flat element (17) inserted in pocket (16) appear to "move" as the pages are flipped. In a variant form of this embodiment, as shown in FIG. 3, the shape and size of the window-like apertures (12) can be varied or stepped every one or more pages and the changes in size and/or shape will allow the user to search much more rapidly for a particular page. Note in particular the recessed aperture (12) shows a page aperture (11*a*) which varies in size from another page aperture (11*b*) positioned immediately beneath it.

Figure 4:
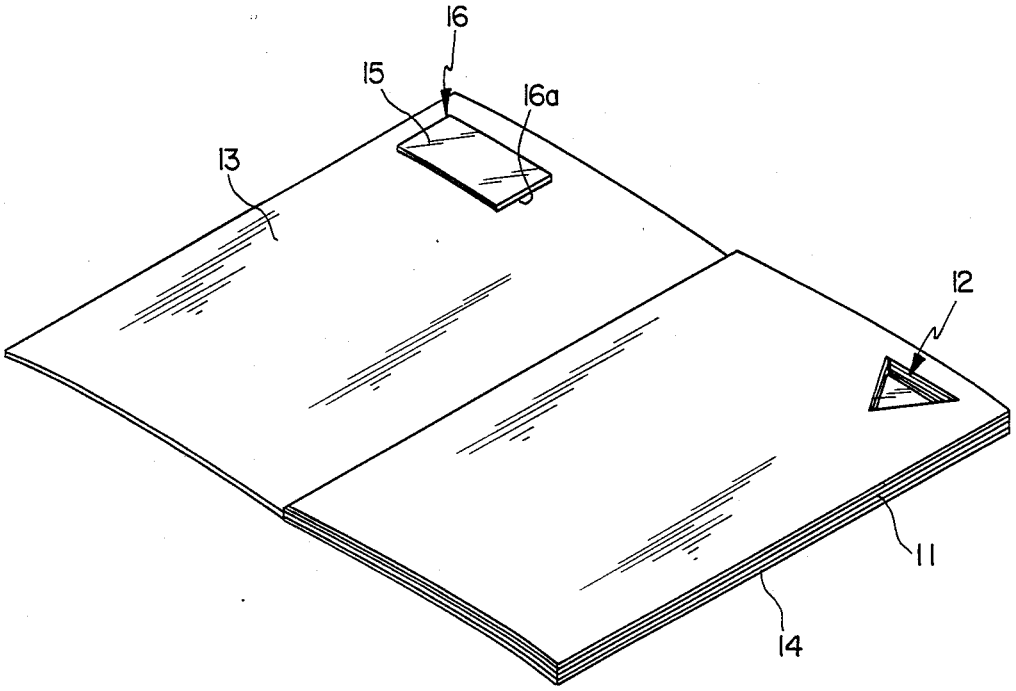
FIG. 4 is a perspective view of a third embodiment of the invention.

FIG. 4 shows a third embodiment of this invention, in which the window-like apertures can be square, rectangular, round, heart-shaped, triangular or of any other desired pleasing shape. If the pages throughout the notebook were to reflect successive changes in shape, it would make letters or drawings on the flat element (17) in pocket (16) look differently and give varying visual impressions from page to page. Such an embodiment would contribute to the uniqueness of the notebook.

Figure 5:
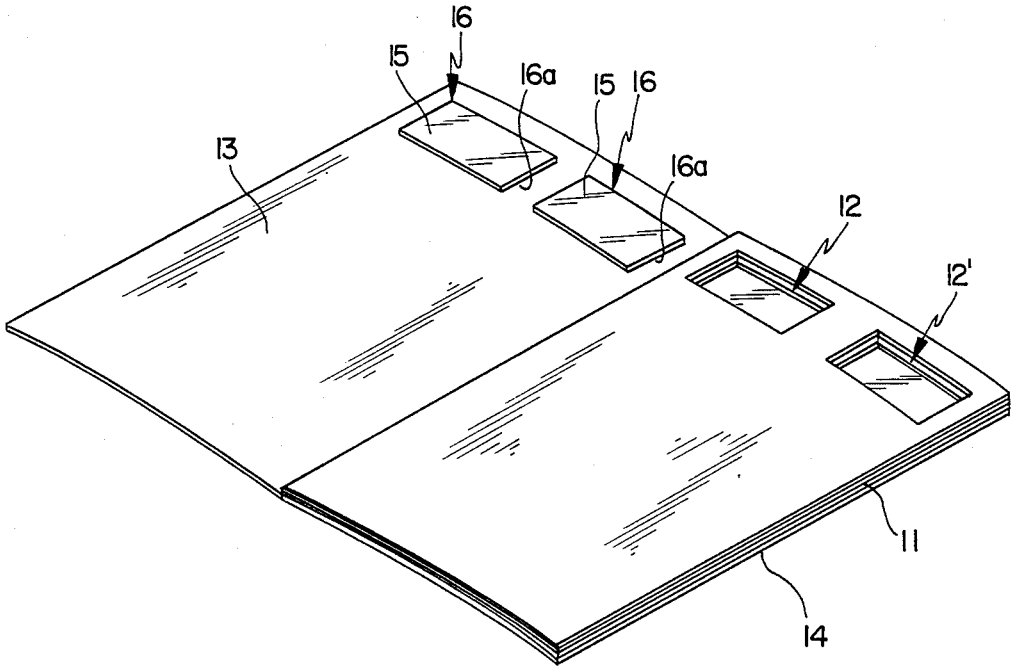
FIG. 5 is a perspective view of a fourth embodiment of the invention.

FIG. 5 is yet a fourth embodiment of this invention, in which more than one series of window-like apertures in cut out of each page. In this case, the pocket (16) can be mounted inside the front and/or back cover opposite the one or more series of the window-like apertures (12). In this embodiment, the user can view as many pictures, drawings or indicia-bearing elements simultaneously as there are series of window-like apertures cut out of each page.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A notebook having unapertured front and back covers and a series of pages bound at one edge thereof comprising, at least one series of substantially aligned window-like apertures being disposed through said pages, with all of said window apertures being of the same size, pocket means disposed on an inside portion of each of said front and back covers, said pocket means being in proximity to a top edge of said pages, said pocket means further including a transparent face portion and at least one open edge adapted to allow said pocket to receive a flat, indicia-bearing element for storage therewithin, said transparent face portion allowing said indicia-bearing element to be viewed through said window-like apertures.

2. A notebook as claimed in claim 1, further wherein said at least one pocket means comprise two pocket means and said at least one series of aligned window-like apertures comprise two series thereof.

3. A notebook as claimed in claim 1, further wherein said at least one pocket means is disposed directly opposite said at least one series of aligned window-like apertures in said pages.

4. A notebook as claimed in claim 1, further wherein said at least one pocket means are disposed on the inside front and back covers simultaneously.

* * * * *